US006418977B1

(12) United States Patent
Tholander

(10) Patent No.: US 6,418,977 B1
(45) Date of Patent: Jul. 16, 2002

(54) YARN PROCESSING SYSTEM WITH WEFT YARN TENSION REGULATION

(75) Inventor: Lars Helge Gottfrid Tholander, Ulricehamn (SE)

(73) Assignee: IRO Patent AG, Baar (CH)

( * ) Notice: Subject to any disclaimer, the term of this patent is extended or adjusted under 35 U.S.C. 154(b) by 0 days.

(21) Appl. No.: 09/868,370

(22) PCT Filed: Dec. 17, 1999

(86) PCT No.: PCT/EP99/10086

§ 371 (c)(1),
(2), (4) Date: Sep. 1, 2001

(87) PCT Pub. No.: WO00/37721

PCT Pub. Date: Jun. 29, 2000

(30) Foreign Application Priority Data

Dec. 18, 1998 (DE) ..... 198 58 682

(51) Int. Cl.[7] ..... D03D 47/34
(52) U.S. Cl. ..... 139/452; 139/194
(58) Field of Search ..... 139/452, 194

(56) References Cited

U.S. PATENT DOCUMENTS 4,359,068 A * 11/1982 Loepfe et al. ..... 139/370.2
5,417,251 A * 5/1995 Josefsson et al. ..... 139/194
5,462,094 A 10/1995 Josefsson et al.
5,476,122 A 12/1995 Schuster et al.
6,105,627 A * 8/2000 Covelli ..... 139/194

FOREIGN PATENT DOCUMENTS

| | | |
|---|---|---|
| DE | 41 31 656 A1 | 3/1993 |
| EP | 0 357 975 | 3/1990 |
| EP | 0 634 509 A1 | 1/1995 |
| EP | 0 756 028 A1 | 1/1997 |

* cited by examiner

*Primary Examiner*—Andy Falik
(74) *Attorney, Agent, or Firm*—Flynn, Thiel, Boutell & Tanis, P.C.

(57) ABSTRACT

A yarn processing system including a feeding device, a power loom, a controllable yarn tension device which is situated downstream from the feeding device, and a tensiometer which supplies a signal that represents the yarn tension and which is arranged downstream from the yarn tension device. The tensiometer includes a separating device which can be adjusted between a passive position and a separating position and with which a temporary separation between the tensiometer and the weft yarn can be effected in order to generate a zero yarn tension signal for a signal analysis device. In addition, the weft yarn is temporarily separated from the tensiometer probe during the interval between successive insertion operations, and a calibration is carried out for a future control operation by using the zero yarn tension signal.

14 Claims, 2 Drawing Sheets

YARN PROCESSING SYSTEM WITH WEFT YARN TENSION REGULATION

FIELD OF THE INVENTION

The invention relates to a yarn processing system including a weft yarn feeding device and a weaving machine, and to a method for feeding weft yarn with a feeding device into a weaving machine.

BACKGROUND OF THE INVENTION

In a gripper weaving machine, the yarn tension profile follows a curve similar to a kardioide caused by accelerations and decelerations of the yarn. In the insertion starting phase, a predetermined yarn tension level is adjusted by a controlled yarn brake such that the bringer gripper properly takes the weft yarn. During the further stroke of the bringer gripper, the braking effect ought to be reduced as far as possible since the yarn tension then increases due :the ion. Shortly prior to the transition phase from the bringer gripper to the taker gripper, the braking effect again has to be increased for a proper transition. During the subsequent acceleration of the taker gripper, the braking effect again ought to be reduced as far as possible, until it finally is to be increased shortly before the insertion end to position the weft yarn in a stretched manner within the shed. In a projectile weaving machine, the braking effect of the controlled yarn brake both is increased in the insertion starting phase and shortly before the insertion end, but is to be reduced as far as possible in the intermediate phase. In a jet weaving machine, an increased braking effect of the yarn brake is of advantage at the insertion end phase to dampen the effect of a dangerous whiplash.

In a yarn processing system known from EP 03 57 975 A, the braking effect is varied during an insertion cycle by means of a signal representing the yarn tension and by a closed regulation loop including the yarn brake. Different positions of the yarn tip within the shed are allocated to different yarn tension values to adapt the overall yarn tension profile to the weaving conditions. Since the yarn tension profile varies among insertion cycles with the same yarn material due to the weft yarn withdrawal action of the weaving machine and also depends upon other influences, it has proved of advantage not to operate with a strictly fixed program of the braking effect of the yarn brake but to control the yarn brake in view of the actual yarn tension profile. The tensiometer, the probe of which is in direct contact with the weft yarn, generates signals representing the actual yarn tension or a signal train representing the actual yarn tension profile, respectively. With the help of this actual signal, the signal evaluation assembly regulates via the yarn brake a nominal yarn tension profile. For the regulating operation, the regulating loop of the tensiometer, the signal evaluation assembly and the yarn brake are closed by the yarn itself. The permanent mechanical contact between the weft yarn and the probe of the tensiometer, however, causes a permanent deterioration of the regulating accuracy. The problem results from a stretching tension caused by the probe within the weft yarn between the feeding device and the insertion device of the weaving machine. Said stretching tension is active even in pauses between insertion cycles, and influences the tensiometer to generate a signal with a value which drifts due to varying exterior circumstances. In addition, operation dependent vibrations in the yarn processing system also influence the stretching of the weft yarn and will be detected by the tensiometer. Even with the weft yarn at rest the signal shows a considerable drifting tendency. As a result, the signal evaluation assembly never has a predetermined or fixed signal value as a proper reference for the regulation. A reliable calibration or resetting, preferably to zero, cannot be carried out as it is needed for high regulation accuracy.

U.S. Pat. No. 5,476,122 A discloses a yarn processing system where a lamella yarn brake is regulated in a closed regulation loop with signals emitted by a tensiometer. FIG. 2 of said publication illustrates that strong stretching tension is active in the weft yarn in pauses between insertion cycles and illustrates that the stretching tension may have differing levels in different pauses (drifting). Since there is no point in time without any detected falsifying yarn tension, no reliable calibration or resetting can be carried out for the tensiometer.

It is an object of the invention to create in a structurally simple way a yarn processing system having high regulation accuracy of the yarn brake control, and to provide a method for improving the regulation accuracy for the yarn tension in a yarn processing system.

Said object is achieved according to the invention by providing a separation device close to the tensiometer within the yarn path to temporarily separate the probe and the weft yarn to allow the signal evaluation assembly to generate a zero yarn tension signal. The object is also achieved by carrying out the method discussed below.

Independent from the magnitude of the stretching tension within the weft yarn which is active even in pauses between insertion cycles, a temporary separation of the weft yarn from the probe of the tensiometer is carried out in the yarn processing system. A stable reference value is gained in the signal evaluation assembly for calibrating or resetting when the weft yarn is separated from the probe. Said reference value is a clear zero yarn signal because the tensiometer does not generate any signal or always the same basis signal when the weft yarn is temporarily separated from the probe. With the help of said zero yarn tension signal, calibrating or resetting can be carried out in a reliable and simple way.

According to the method the zero yarn tension signal intentionally is generated for the purpose of calibration of the signal evaluation assembly. The regulation accuracy is significantly increased by rerlatively simple structural methods. The separation device stays passive during the normal regulation process and does not then have any influence the weft yarn tension control.

The separation device is actuated by an adjustment drive which expediently is connected to a control device. An information signal is transmitted via the information connection to the signal evaluation assembly, such that the signal evaluation assembly can use the zero yarn tension signal as a reference for calibrating or resetting, respectively.

The separation device includes at least one lifting element. The weft yarn is lifted from the probe of the tensiometer during the separation in a structurally simple way. The lifting element, when carrying out the separation, only engages at the weft yarn for a calibration step of the evaluation assembly. This is done while the weft yarn has stopped. Said engagement thus does not influence the subsequent yarn run.

Alternatively, the probe of the tensiometer or the tensiometer itself, is adjusted in relation to the weft yarn into the passive position to separate the probe from the weft yarn.

In one embodiment, a rod-like or yarn eyelet-like lifting element is provided as a yarn deflector which is structurally simple.

In one embodiment, the adjustment drive includes an electromagnet, an electric motor or a pneumatic cylinder, and operates in a structurally simple and reliable way.

The signal evaluation assembly includes a calibration part for calibrating or resetting. Said part responds to the zero yarn tension signal as soon as the separation has taken place.

The invention also relates to a method for intermittently feeding weft yarn with a feeding device into a weaving machine, including temporarily separating the weft yarn and tensiometer probe, deriving a zero yarn tension signal during the separated state, calibrating the yarn tension signal on the basis of the zero signal, and registering the calibration as a basis for an upcoming yarn brake regulation cycle.

In one embodiment, the calibration is made as soon as the weft yarn has stopped and/or is not braked anywhere else.

According to the invention the weft yarn and the scanning probe of the tensiometer are temporarily separated from one another to gain a valuable and clear zero yarn tension signal for a calibration step. This is of particular importance for tensiometers operating with a piezo transducer. Alternatively, the separation is also useful for tensiometers employing strain gauge strips, a capacity sensor, a piezo resistive element, or for other electronic yarn tension measuring principles like triboelectrical devices, each of which needs contact of the yarn for sensing the yarn tension.

BRIEF DESCRIPTION OF THE DRAWINGS

Embodiments of the invention will be described with reference to the drawings.

DETAILED DESCRIPTION.

Figure 1:
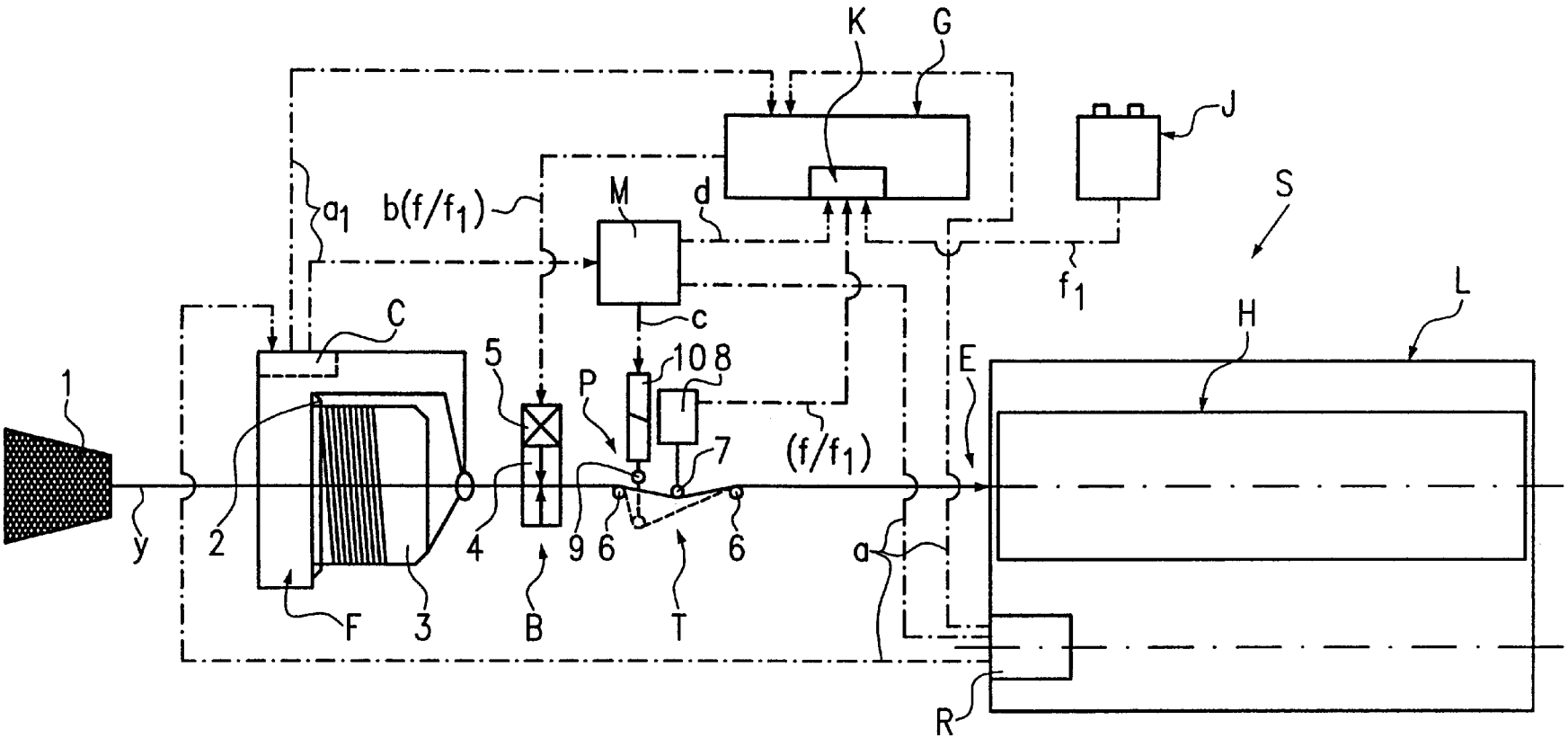
FIG. 1 is a schematic illustration of a yarn processing system.

A yarn processing system in FIG. 1 includes a yarn feeding device F and a weaving machine F comprising a shed H (a gripper or a rapier weaving machine, a projectile weaving machine or a jet weaving machine). The yarn feeding device F pulls a weft yarn Y from a storage bobbin 1. By means of a rotating drive 2, the weft yarn Y is intermediately stored in adjacent turns on a storage drum 3 and is fed to the weaving machine L intermittently. The rotating drive 2 is controlled by a control device C of the yarn feeding device F. Within the yarn path between the feeding device F and an insertion device E at the entrance of the shed H of the weaving machine L, a controlled yarn brake B of suitable design and a downstream tensiometer T are provided. A separation device P is associated with the tensiometer.

The yarn brake B may be a lamella brake, a deflection brake, an air nozzle brake, a band brake, or the like. The yarn brake B shown has braking elements 4, at least one of which is adjustable in relation to the other by an actuator 5 to vary the braking effect in the passing weft yarn Y. The tensiometer T contacts the weft yarn Y with a probe 7 belonging to a transducer 8 generating a signal f representative of the yarn tension. At both sides of probe 7, the weft yarn Y can be supported by stationary yarn guiding elements 6.

The separation device P includes a lifting element 9, e.g. formed as a rod or a yarn eyelet or a fork. Lifting element 9 is coupled to an adjustment drive 10 and can be moved back and forth lateral to the yarn running direction between a passive position (full lines) and a separating position (dotted lines). The weft yarn Y can be separated by lifting element 9 from the probe 7 of tensiometer T. Then, transducer 8 generates a signal fo, i.e. a zero yarn tension signal when the probe 7 and the weft yarn Y are separated from each other. The adjustment drive 10 can be connected to a control M.

Furthermore, an electronic signal evaluation assembly G is provided which may contain a calibration part K. An insertion part J can be associated with the signal evaluation assembly G allowing predetermined parameters or control curves to be set which then are supplied as a signal f1 to the signal evaluation assembly G or its calibration part K, respectively. The transducer 8 of the tensiometer T and also the control M of the separation device P (or its adjustment drive 10) are connected to the calibration part K for signal transmission. Control M can supply information d to the calibration part K which e.g. represents the initial position of the lifting element 9, and particularly its established separating position. Furthermore, signal evaluation assembly G can be connected to the control device C of the feeding device F and/or a drive R of the weaving machine L which in turn may be connected to control device C. Finally, control device C can also be connected to control M. From drive R of the weaving machine L, signals "a" can be transmitted to control device C and/or control M and/or signal evaluation assembly G. Said signals "a" represent e.g. the initial rotation angle or predetermined rotation angle values of the main shaft of the weaving machine L. Signals "al" can be transmitted from control device C to control M and/or the signal evaluation assembly G which signals "al" e.g. represent the operational state of yarn feeding device F. From signal evaluation assembly G, a signal b can be supplied to the actuator 5 of the yarn brake B. Signal b is a function of signal f or/and f1 or e.g. is proportional to said signal to control the braking effect of the yarn brake B accordingly. The yarn brake B, the signal evaluation assembly G and the tensiometer T define a regulating loop which is closed by the weft yarn Y itself. Within said regulating loop, a yarn tension profile is produced in consideration of the detected yarn tension which yarn tension profile e.g. is adapted to the weaving conditions in the weaving machine L and/or the yarn quality and/or the weaving width, etc.

Tensiometer T may operate by employing a piezoelectrical, piezo-resistive, triboelectrical or capacitive effect or with the help of strain gauge strips, such that signal f can be derived from the actuating force of the weft yarn Y at the probe 7, which signal f represents the yarn tension. When the separation device P is adjusted to the separating position, probe 7 is no longer actuated by the weft yarn Y. Then, tensiometer T generates a zero yarn tension signal fo, and signal evaluation assembly G or its calibration part K, respectively, carry out a calibration or resetting step based upon this signal fo.

Depending on the type of the weaving machine L, different types of yarn tension profiles may be expedient for the respective insertion cycles. For a gripper or rapier weaving machine with bringer and taker grippers, the yarn brake has to operate actively in a controlled fashion at the beginning of an insertion, in the transition phase and close to the insertion end, but should brake as weakly as possible during intermediate periods. For a projectile weaving machine, the yarn brake ought to be variably adjusted during each insertion cycle. For an air jet weaving machine, the yarn brake should be active in a controlled fashion by engagement close to the insertion end to dampen or eliminate a dangerous whiplash or stretching The method of intermittently feeding weft yarns from feeding device F to a gripper or rapier weaving machine is explained in detail by FIG. 2. The upper part of the diagram shows the yarn tension indicated in grams on the vertical axis. The horizontal axis represents time or the rotational angle of the main shaft of the weaving machine L. An insertion cycle shows a yarn tension profile similar to a cardioide or heart-shaped curve resulting from the acceleration and deceleration of the bringer gripper on its way to the middle of the shed, from the yarn transition phase from the bringer gripper to the taker gripper, and the subsequent acceleration and finally the deceleration of the taker gripper at the insertion cycle end. An insertion cycle extends over a path of a 360° rotation of the weaving machine main shaft only. Between subsequent insertion cycles, pauses exist.

During the pauses, the stopped weft yarn between the feeding device F and the insertion device E is subjected by the probe 7 and other influences to a predetermined stretching tension normally also scanned by the tensiometer T. Thus, signal f could normally never drop to zero. To the contrary, in pauses, signal f would drift, i.e. would increase or decrease.

Figure 2:
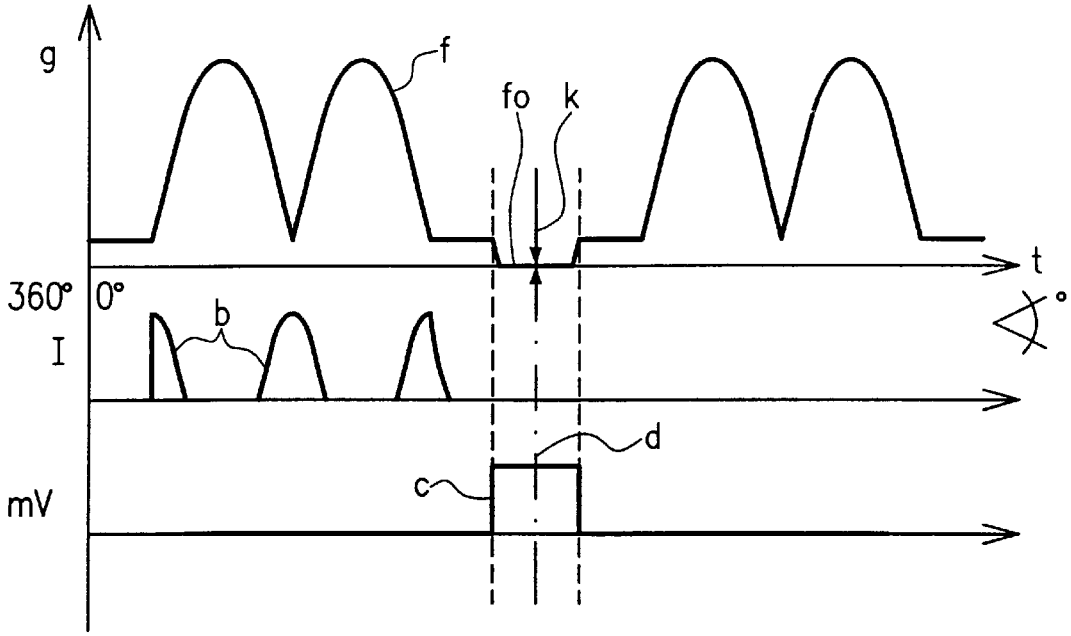
FIG. 2 is a diagram illustrating the yarn tension profile, the operating current supplied to a yarn brake, and the control of a separation device, in a gripper or rapier weaving machine.

The middle part of the diagram in FIG. 2 illustrates the current supplied to yarn brake B, i.e. the signal b (e.g. indicated by the current 1). The lower part of the diagram illustrates the current supply or the control of adjustment drive 10, i.e. signal c (e.g. mV).

Yarn brake B is controlled during an insertion cycle at the beginning of the insertion, in the transition phase and close to the insertion end, respectively, under consideration of signal f by signal b adjusting a predetermined variable braking effort or a predetermined curve. As soon as an insertion cycle ends, about which control M is informed from the feeding device F and/or from the weaving machine L (by signal a or al, respectively), signal c is generated to actuate adjustment drive 10 and to bring lifting element 9 into its separation position. The weft yarn Y will be separated from the probe 7. Despite the still existing stretching tension in the weft yarn, tensiometer T then generates a zero yarn tension signal fo. Coincident with the generation of signal c (or during the time duration of signal c and the time duration for maintaining the separating position of lifting element 9), signal d is transmitted to calibration part K, as a confirmation that the now present signal actually is the zero yarn tension signal fo. This does not necessarily mean that the electrical signal value then also is zero. Said confirmation or a similar confirmation signal also could originate from control device C or drive,R. Next in the signal evaluation assembly G or its calibration part K, respectively, a calibration k or a resetting step, preferably to a zero value, is carried out. Then, signal evaluation assembly G is in possession of a reliable, stable reference value for the upcoming regulation process. Prior to the start of the next insertion cycle, signal c vanishes. Probe 7 again makes contact with weft yarn Y. The tensiometer T now has exact knowledge of the actual yarn tension in relation to the reference value gained by the calibration step. During the subsequent insertion cycle, control of yarn brake B again will be carried out as commanded by signal f, however, on the basis of the earlier made calibration or resetting. For other types of weaving machines, the yarn tension profile regulated by the yarn brake B is different from the one shown in FIG. 2. However, during pause between insertion cycles, a calibration is made as described in connection to FIG. 2.

In FIG. 1 lifting element 9 is a yarn eyelet, a fork or a rod, for deflecting the weft yarn Y out of its straight trajectory between the stationary yarn guiding elements 6 so that the probe 7 and the weft yarn Y will be reliably separated from one another. Both stationary yarn guiding elements 6 are not necessary in every case, however.

Figure 3:
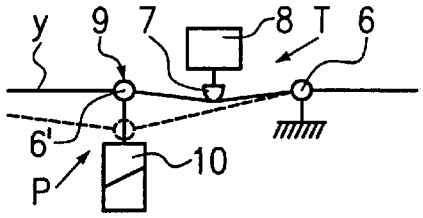
FIGS. 3 to 6 illustrate different embodiments of separating devices respectively combined with a tensiometer.

Instead of providing a first or leading stationary yarn guiding element 6 as in FIG. 1, in FIG. 3 a movable yarn eyelet 6' or a movable yarn guiding element can be provided forming lifting element 9 of separation device P. In this case the adjustment drive 10 directly engages at said yarn guiding element 6' to displace it from its passive position (full lines) into the separating position (dotted lines) and to lift the weft yarn Y from the probe 7 of the tensiometer T. Alternatively, the other yarn guiding element 6 trailing in the yarn run direction behind probe 7 could be displaced.

Figure 4:
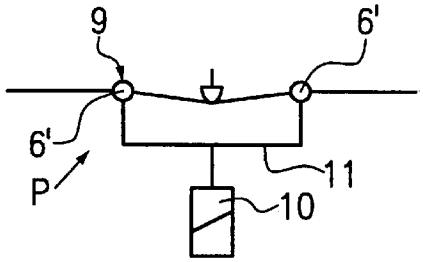

In FIG. 4 both yarn guiding elements 6' are provided at a fork-like carrier 11 which can be displaced by adjustment drive 10 out of the passive position (full lines) into a separating position (not shown). Both yarn guiding elements 6', e.g. are ring-shaped yarn eyelets which commonly define the lifting element or-lifting elements of this separation device P.

Figure 5:
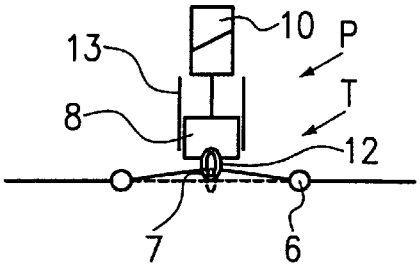

In FIG. 5 probe 7 of tensiometer T e.g. is formed as a ring-shaped piezo element 12 with its transducer 8. Transducer 8 e.g. is held displaceable in a vertical guiding structure 13 and can be shifted downwardly by adjustment drive 10 from the active position (full lines) for sensing the yarn into the passive position (dotted lines) until the weft yarn no longer touches ring-shaped piezo element 12.

Figure 6:
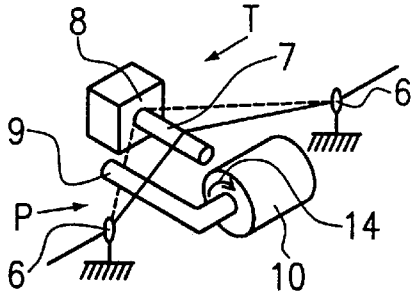

In FIG. 6 separation device P has an adjustment drive 10 which is a rotary drive by which rod-shaped lifting element 9 can be displaced from a passive position (full lines) in the direction of an arrow 14 into a separation position (dotted lines) to separate the weft yarn Y from probe 7 of tensiometer T while supported at both stationary yarn guiding elements 6. Probe 7 e.g. is rod-shaped and can be coupled with transducer 8 via not shown strain gauge strips (not shown), or a triboelectrical element, or the like.

A calibration step could even be carried out during an insertion cycle, since the lifting step does not have a significant influence on the yarn. Optionally the calibration would then be carried out during a phase in which the weft yarn is not braked. Alternatively, tensiometer T could be provided upstream of yarn brake B.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. Yarn processing system comprising a weft yarn feeding device and a weaving machine, at least one controlled yarn brake and a tensiometer disposed within the weft yarn path leading into a weaving shed, said yarn brake being controlled by an electronic signal evaluation assembly and actuated by an actuator, said tensiometer having a probe which actively engages at said weft yarn to generate at least one signal corresponding to the actual yarn tension, said tensiometer being in signal transmitting connection with said signal evaluation assembly for controlling said yarn brake based upon the detected yarn tension, wherein a separation device is provided within the yarn path which is adjustable into a separating position to temporarily separate said probe and said weft yarn and allow the signal evaluation assembly to generate a zero yarn tension signal.

2. Yarn processing system as in claim 1, wherein said separation device includes an adjustment drive connected to a control, and an information connection is provided between said control or said adjustment drive and said signal evaluation assembly for transmission of a confirmation signal confirming at least one adjusted position of said separation device.

3. Yarn processing system as in claim 2, wherein said adjustment drive comprises an electromagnet, an electric motor or a pneumatic cylinder.

4. Yarn processing system as in claim 2, wherein said separation device is adjustably movable by said drive between said separating position to temporarily separate said probe and said weft yarn and a passive position wherein said probe is engaged with the weft yarn, and said confirmation signal confirms that said separation device is in said separating position.

5. Yarn processing system as in claim 4, wherein said signal evaluation assembly resets the one signal to a zero value based upon the zero yarn tension signal upon confirmation of said separating position of said separation device.

6. Yarn processing system as in claim 5, including a pair of yarn guiding elements disposed on opposite sides of said probe for supporting the weft yarn, one of said yarn guiding elements comprising said separating device and being movable into said separating position to separate the weft yarn from said probe.

7. Yarn processing system as in claim 5, including a pair of yarn guiding elements disposed on opposite sides of said probe for supporting the weft yarn, said pair of yarn guiding elements comprising said separating device and being carried on a fork-shaped element associated with said drive which displaces said yarn guiding elements into said separating position to separate the weft yarn from said probe.

8. Yarn processing system as in claim 1, wherein said separation device includes at least one lifting element for lifting engagement with the weft yarn at least in the separating position of said separating device.

9. Yarn processing system as in claim 8, wherein said lifting element is a yarn deflector shaped as a rod or a yarn eyelet.

10. Yarn processing system as in claim 1, wherein said probe comprises said separation device and is movable into the separating position for separation from the weft yarn.

11. Yarn processing system as in claim 1, wherein said signal evaluation assembly includes a calibration part, and when the separating position is confirmed, said calibration part calibrates the one signal to a predetermined starting value which corresponds to the zero yarn tension signal.

12. Method for intermittently feeding weft yarn with a feeding device into a weaving machine wherein during each insertion cycle the weft yarn tension is varied by a controlled yarn brake integrated into a closed regulation loop containing a signal evaluation assembly which regulates the braking effect of said yarn brake at least based upon a yarn tension signal derived downstream of said yarn brake by a tensiometer having a probe which actively contacts said weft yarn, said method comprising the steps of:

temporarily separating the weft yarn and said tensiometer probe from one another;

deriving a zero yarn tension signal during the separated state of the weft yarn and the tensiometer probe;

carrying out a calibration of the yarn tension signal on the basis of said zero yarn tension signal; and registering said calibration as a basis for an upcoming yarn brake regulation cycle. including a pair of yarn guiding elements disposed on opposite sides of said probe for supporting the weft yarn, one of said yarn guiding elements comprising said separating device and being movable into said separating position to separate the weft yarn from said probe.

13. Method as in claim 12, further including a step of carrying out said separation and said calibration steps during a pause between insertion cycles.

14. Method as in claim 8 including generating a signal which confirms the separation of said probe and the weft yarn and transmitting said signal to the signal evaluation assembly prior to said calibration step.

* * * * *